US010820723B2

(12) United States Patent
Liu

(10) Patent No.: US 10,820,723 B2
(45) Date of Patent: Nov. 3, 2020

(54) ROTARY COFFEE BAG HOLDER

(71) Applicant: Xiaofeng Liu, Guangdong (CN)

(72) Inventor: Xiaofeng Liu, Guangdong (CN)

( * ) Notice: Subject to any disclaimer, the term of this patent is extended or adjusted under 35 U.S.C. 154(b) by 0 days.

(21) Appl. No.: 16/671,168

(22) Filed: Nov. 1, 2019

(65) Prior Publication Data

US 2020/0146468 A1 May 14, 2020

(30) Foreign Application Priority Data

Nov. 9, 2018 (CN) ..... 2018 2 1849084 U

(51) Int. Cl.
*A47F 5/02* (2006.01)
*A47F 5/05* (2006.01)
*A47F 5/025* (2006.01)

(52) U.S. Cl.
CPC ..... *A47F 5/05* (2013.01); *A47F 5/02* (2013.01); *A47F 5/025* (2013.01)

(58) Field of Classification Search
CPC .... A47F 5/05; A47F 5/025; A47F 5/04; A47F 5/02; A47J 47/16; A47B 49/004
See application file for complete search history.

(56) References Cited

U.S. PATENT DOCUMENTS 1,393,050 A * 10/1921 Talley ..... A47F 3/10 312/135
1,810,941 A * 6/1931 Blomberg ..... A47B 49/00 211/44
3,608,739 A * 9/1971 Duboff ..... A47F 5/05 211/40
4,548,324 A * 10/1985 Mackey, Jr. ..... A47F 5/02 211/129.1
5,607,065 A * 3/1997 Todd ..... G11B 23/0236 211/163
D536,936 S * 2/2007 Tiemann ..... A47J 31/44 D7/704
D621,640 S * 8/2010 Tiemann ..... A47J 47/16 D7/600.2
D623,875 S * 9/2010 Snider ..... A47J 47/16 D6/680.3
D626,382 S * 11/2010 Tiemann ..... A47J 47/16 D7/600.2
8,272,519 B1 * 9/2012 Rekhels ..... A47F 5/02 108/139

(Continued)

FOREIGN PATENT DOCUMENTS

GB 810911 A * 3/1959 ..... A47F 5/05

*Primary Examiner* — Kimberley S Wright

(57) ABSTRACT

The invention relates to a rotary coffee bag holder, comprising a base and a center pillar disposed thereon, the center pillar being rotatably connected with a coffee bag holder, wherein the upper end of the coffee bag holder is provided with a first turntable and a lower end is provided with a second turntable, the top end of the center pillar is mounted with a connecting seat, the central pillar passes through the second turntable, the connecting seat is matched with the first turntable, and the top surface of the connecting seat is provided with a boss against the first turntable. The boss is in contact with the first turntable in a point, with a small contact area, so that the rotation is smoother, more flexible, and the noise is lower; the rotation function realizes that the bearing does not need to be disposed.

5 Claims, 4 Drawing Sheets

(56) References Cited

U.S. PATENT DOCUMENTS

| | | | | |
|---|---|---|---|---|
| 8,371,459 | B1 * | 2/2013 | Rekhels | A47F 5/02 108/139 |
| 9,022,236 | B1 * | 5/2015 | Amendolea | B65G 1/026 211/144 |
| D865,454 | S * | 11/2019 | Liu | D7/600.2 |
| 2003/0015486 | A1 * | 1/2003 | Chen | A47F 5/02 211/70 |

* cited by examiner

ROTARY COFFEE BAG HOLDER

CROSS REFERENCE TO RELATED APPLICATIONS

The present application claims the benefit of Chinese Patent Application No. 201821849084.6 filed on Nov. 9, 2018, the contents of which are incorporated herein by reference in their entirety.

TECHNICAL FIELD

The present disclosure relates to a coffee bag holder for containing a coffee bag, in particular to a rotary coffee bag holder.

BACKGROUND

The coffee bag holder is used to hold a coffee bag (also called a coffee capsule). Since the coffee bag holder can hold a plurality of coffee bags, some coffee bag holders have a rotating function, and the side of the coffee bag is turned to the user by rotating, which is convenient for taking and storing a coffee bag.

In the prior art, bearings are arranged on the rotating parts of the coffee bag holder, the cost is high, and the installation process is complicated, so further improvement is needed.

SUMMARY

The object of the present disclosure is to overcome the deficiencies of the prior art described above, and to provide a rotary coffee bag holder which has no bearing structure, low cost, without risk of oil leakage.

The object of the present disclosure is achieved in this way:

A rotary coffee bag holder includes a base and a center pillar arranged thereon, the center pillar is rotatably coupled to a coffee bag holder, wherein, an upper end of the coffee bag holder is provided with a first turntable, a lower end is provided with a second turntable, a top end of the center pillar is provided with a connecting seat, and the center pillar passes through the second turntable, such that the connecting seat is engaged with the first turntable, and a top surface of the connecting seat is provided with a boss against the first turntable.

The connecting seat has a cylindrical shape, and the top end thereof is rotatably connected to a seat cover disposed at a middle portion of the first turntable; a bottom end is inserted and fixed to the top end of the center pillar.

The side of the connecting seat is provided with a limit step that abuts against the top end of the seat cover and/or the center pillar.

The second turntable has a limit sleeve mounted on the second turntable, and the limit sleeve is provided with a limit shaft hole adapted for the center pillar to pass through.

The outer portion of the limit sleeve is provided with a concave buckle groove, and the center of the second rotating wheel is provided with a turntable hole position, and the turntable hole position is sleeved in the buckle groove.

The lower part of the side wall of the limit sleeve is provided with a slope for inserting the turntable hole position, and the upper part of the side wall is provided with a step for abutting against the end surface of the second turntable.

The lower end side wall of the center pillar is provided with a limit block, and the lower end of the limit block is adjacent to the limit sleeve, and the limit block is fixed to the lower end side wall of the center pillar by a rivet.

The limit block is provided with a waist-shaped hole, and the rivet mounts with the center pillar by penetrating the waist-shaped hole, and the length of the waist-shaped hole is larger than the diameter of the rivet, so that the rivet can be finely adjusted up and down with respect to the rivet.

The coffee bag holder is provided with a plurality of layers of coffee bag shelves from top to bottom.

The boss is a spherical or approximately spherical surface or a boss having a tip portion, and a common feature of the structures is that the area against which the boss abuts the first turntable is reduced.

The beneficial effects of the present disclosure are as follows:

(1) The first and second turntables of the coffee bag holder are respectively rotatably connected to the center pillar through the first and second plastic rotating shafts, thereby realizing the rotation function of the coffee bag holder, and the rotation function is realized without arranging the bearing, thereby effectively reducing the manufacturing cost, the assemble and disassemble are easy, and the manufacturing process is simple.

(2) The boss and the first turntable form a point contact, and the contact area is small, so that the rotation is smoother, more flexible, and less noise.

DETAILED DESCRIPTION OF EMBODIMENTS

Figure 1:
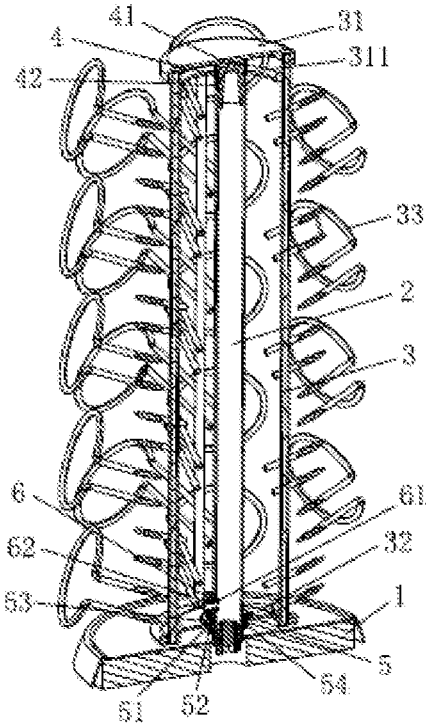
FIG. 1 is a cross-sectional view according to an embodiment of the present invention.
Figure 2:
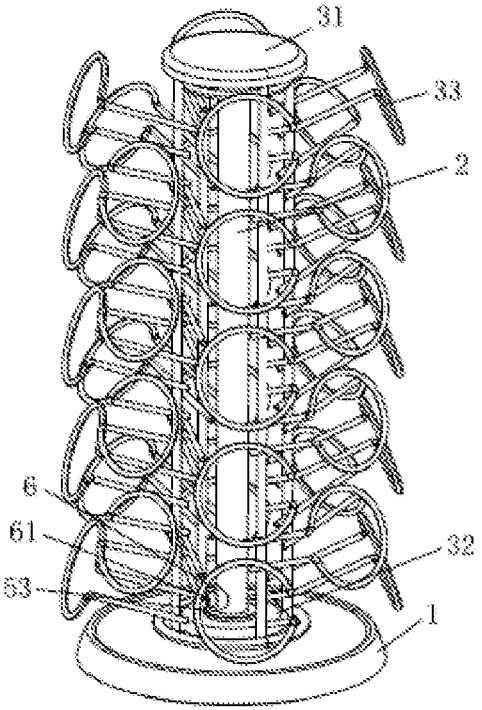
FIG. 2 is a perspective view according to an embodiment of the present invention.
Figure 3:
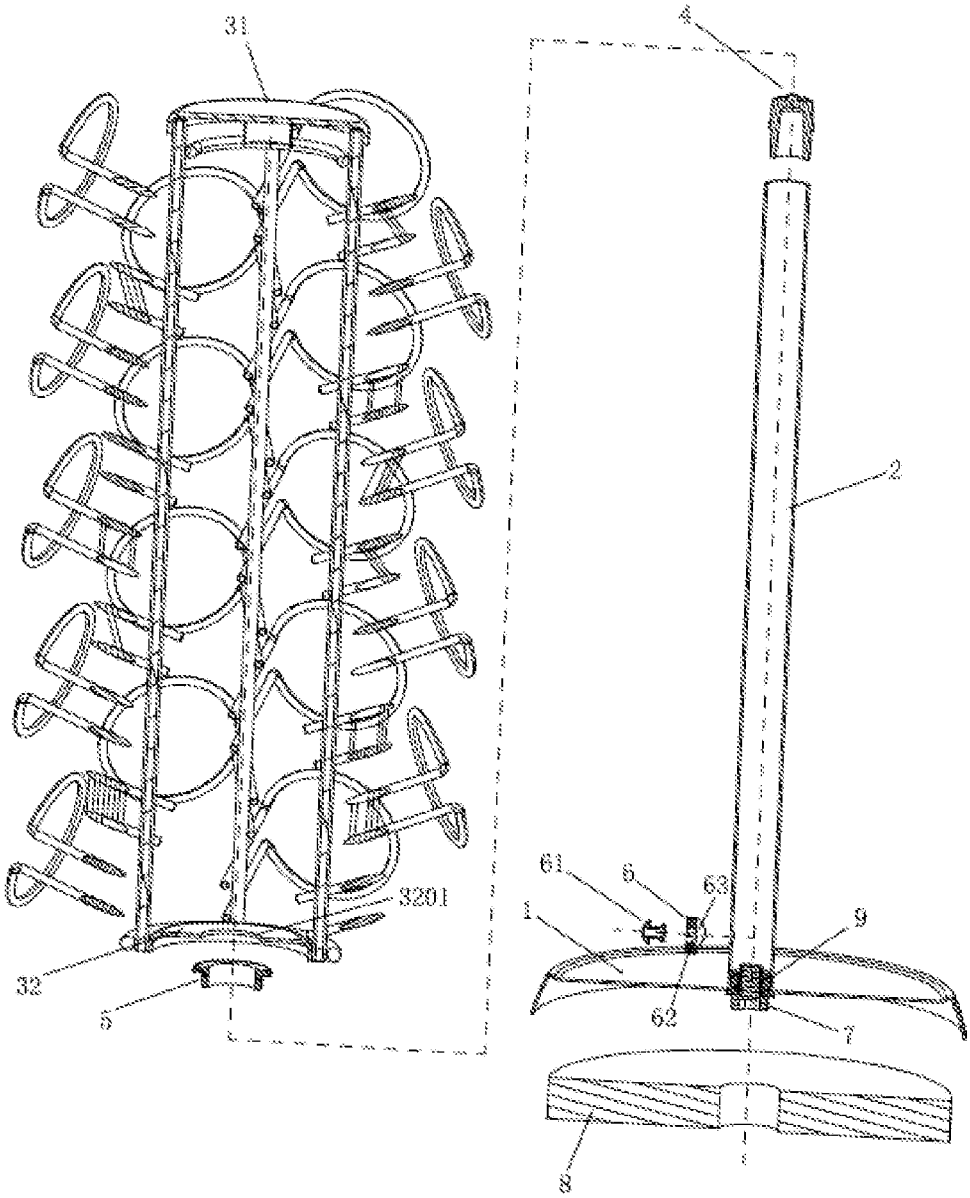
FIG. 3 is an exploded view according to an embodiment of the present invention.
Figure 4:
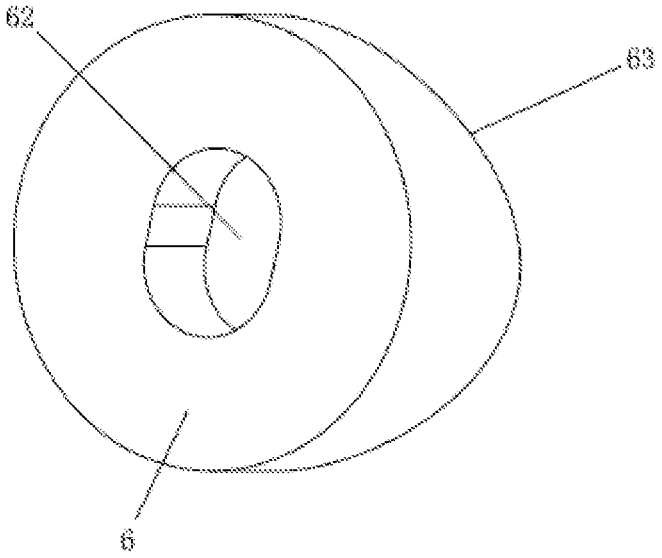
FIG. 4 is a schematic structural view of a limit block according to the first embodiment of the present invention.

The invention is further described below in conjunction with the drawings and embodiments.

Referring to FIGS. 1-6, the rotary coffee bag holder includes a base 1 and a center pillar 2 disposed thereon, the center pillar 2 is rotatably coupled to a coffee bag holder 3, wherein an upper end of the coffee bag holder 3 is provided with a first turntable 31, a lower end is provided with a second turntable 32, a top end of the center pillar 2 is provided with a connecting seat 4, and the center pillar 2 passes through the second turntable 32, such that the connecting seat 4 is engaged with the first turntable 31, and a top surface of the connecting seat 4 is provided with a boss 41 against the first turntable 31.

The first turntable 31 of the coffee bag holder 3 is rotatably connected with the center pillar 2 through the connecting seat 4, thereby realizing the rotation function of the coffee bag holder, and the rotation function of the coffee bag holder does not need to be provided with bearings, thereby effectively reducing the manufacturing cost, and the rotation is flexible and smooth. Moreover, the connecting seat 4 can be made of plastic or metal or plastic and metal fusion structure, wherein the plastic has self-lubricating property as a best embodiment, and the rotational friction between the first turntable 31 and the center pillar 2 is smaller with lower noise, the rotation of the coffee bag holder 3 is smoother. The second turntable 32 has a limit structure (below for detail), so that the entire coffee bag holder 3 does not shake, and the coffee bag holder rotates more quietly.

Further, the connecting seat 4 has a cylindrical shape, the top end of which is rotatably connected to the seat cover 311 disposed at the middle of the first turntable 31, and the bottom end is inserted and fixed at the top end of the center pillar 2. The seat cover 311 serves as limiting for the connecting seat 4, and the insertion and removal is convenient, the bottom end of the seat cover 311 can be fixed at the top end of the center pillar 2 that positioning is achieved.

Moreover, the side portion of the connecting base 4 is provided with a limit step 42 abutting against the top end of the seat cover 311 and/or the center pillar 2. In the embodiment, preferably, the limit step 42 abutting against the upper end of the center pillar 2 is disposed at the side of the first plastic rotating shaft 4, and the limit step 42 limits the assembly of the connecting seat 4 and the center pillar 2.

Further, the second turntable 32 and the second turntable 32 are mounted with a limit sleeve 5, and the limit sleeve 5 is provided with a limit shaft hole 54 adapted to pass through the center pillar 2. The limit sleeve 5 constitutes the aforementioned limit structure, and is preferably made of PP plastic, which can effectively reduce the noise generated by the collision between the limit sleeve 5 and the center pillar 2 when the second turntable 32 is rotated or transported.

Further, the outer portion of the limit sleeve 5 is provided with a concave buckle groove 51, and the center of the second turntable 32 is provided with a turntable hole position 3201 (specifically, a hole position at which the second turntable 32 and the limit sleeve 5 are fitted and matched), The turntable hole position 3201 is sleeved in the buckle groove 51 to ensure that the second turntable 32 is accurately and stably mounted with the limit sleeve 5, so as to avoid the virtual position of the assembly of the two.

Further, the lower portion of the side wall of the limit sleeve 5 is provided with a slope 52 for inserting the turntable hole position. The upper portion of the side wall is provided with a step 53 for abutting against the end surface of the second turntable 32. The arrangement of the slope 52 is convenient for inserting the second turntable hole position 3201 of the turntable 32, and the upper part of the side wall is provided with a step 53 for abutting against the end surface of the second turntable 32, which functions as a limit and anti-off.

Further, the lower end side wall of the center pillar 2 is provided with a limit block 6. The lower end of the limit block 6 is adjacent to the limit sleeve 5, and the limit block 6 is fixed to the lower end side wall of the center pillar 2 by the rivet 61. (The limit block 6 of the embodiment is close to the limit sleeve 5, so that the whole coffee bag holder 3 does not have a large virtual position when transported or used, and the structure is more compact); the assembly manner of the limit block 6 is that the limit block 6 is fixed to the lower end side wall of the center pillar 2 by a rivet 61.

Further, the limit block 6 is provided with a waist-shaped hole 62, and the rivet 61 is inserted into the waist-shaped hole 62 to be installed with the center pillar 2, and the length of the waist-shaped hole 62 is larger than the diameter of the rivet 61. The spacing between the limit block 6 and the limit sleeves 5, since that the length of the waist hole 62 is larger than the stud diameter of the rivet 61, the rivet can be finely adjusted up and down by adjusting the limit block 6, and the fine adjustment function is caused by the production process, resulting that the difference between the limit block 6 and the limit sleeve 5 is different in each product. The operation is simple and reliable by the fine adjustment in the above manner; the structure is more compact.

Figure 5:
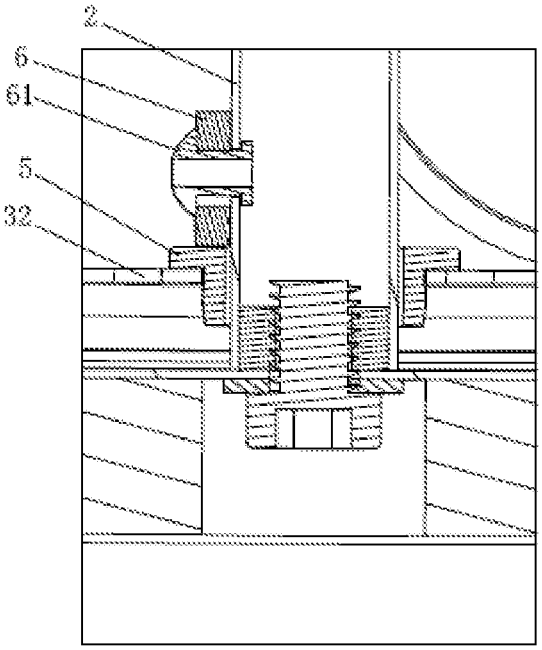
FIG. 5 is a cross-sectional view of the lower limit after being adjusted down according to the present invention.
Figure 6:
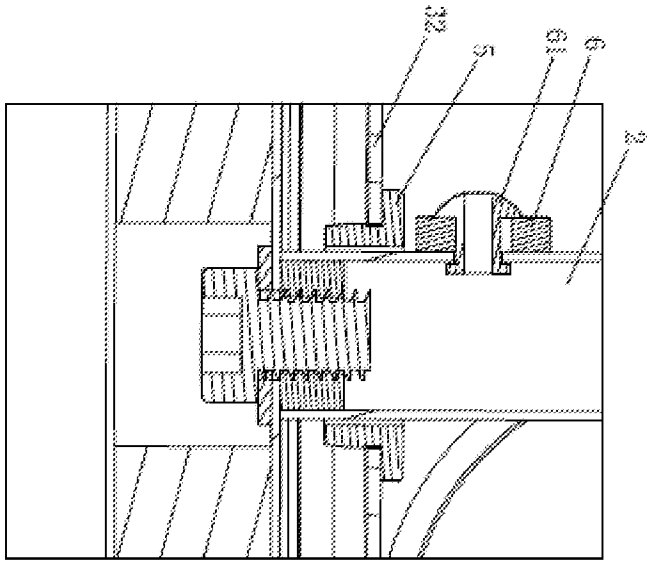
FIG. 6 is a cross-sectional view of the limit block after being adjusted up according to the present invention.

The waist-shaped hole or the elongated hole 62 allows the limit block 6 to move up and down with respect to the rivet 61, thereby adjusting the upper and lower positions, and the tolerance adapting range is larger. The two states after fine adjustment are shown in FIG. 5 and FIG. 6.

Further, the coffee bag holder 3 is provided with a plurality of layers of coffee bag shelves 33 from top to bottom to accommodate more coffee bags.

The boss 41 is a spherical surface or an approximately spherical surface or a boss having a tip portion. The common feature of the structures is that the area against which the boss 41 abuts the first turntable 31 is reduced.

The center pillar 2 is fixed to the base 1 by bolts 7 and a nut 9 fixed in the center pillar 2.

A soft pad 8 is also mounted in the base 1 to prevent the base 1 from scratching the table surface of the coffee bag holder of the present disclosure.

Wherein, the side surface of the limit block 6 is provided with a curved surface 602 that cooperates with the central pillar 2.

The above is a preferred embodiment of the invention, showing and describing the basic principles, main features and advantages of the invention. Those skilled in the art will appreciate that the present disclosure is not limited by the foregoing embodiments, and that the present disclosure is described in the foregoing description of the embodiments and the specification of the invention. Variations and modifications are intended to fall within the scope of the invention as claimed. The scope of the invention is defined by the appended claims and their equivalents.

What is claimed is:

1. A rotary coffee bag holder comprising a base (1) and a center pillar (2) arranged thereon, the center pillar (2) being rotatably coupled to a coffee bag holder (3), wherein, an upper end of the coffee bag holder (3) is provided with a first turntable (31), a lower end is provided with a second turntable (32), a top end of the center pillar (2) is provided with a connecting seat (4), and the center pillar (2) passes through the second turntable (32), such that the connecting seat (4) is engaged with the first turntable (31), and a top surface of the connecting seat (4) is provided with a boss (41) against the first turntable (31);

wherein the connecting seat (4) has a cylindrical shape, and a top end thereof is rotatably connected to a seat cover (311) disposed at a middle portion of the first turntable (31); a bottom end is inserted and fixed to the top end of the center pillar (2);

wherein a side of the connecting seat (4) is provided with a limit step (42) against the top end of the central pillar (2);

the second turntable (32) is provided with a limit sleeve (5), and the limit sleeve (5) is provided with a limit shaft hole (54) adapted for the center pillar (2) to pass through;

wherein an outer portion of the limit sleeve (5) is provided with a concave buckle groove (51), and the center of the second turntable (32) is provided with a turntable hole position (3201) sleeved in the buckle groove (51);

wherein a lower part of a side wall of the limit sleeve (5) is provided with a slope (52) for inserting the turntable hole position (3201), and an upper part of the side wall is provided with a step (53) abutting against an end surface of the second turntable (32).

2. The rotary coffee bag holder according to claim 1, wherein a lower end side wall of the center pillar (2) is provided with a limit block (6), and a lower end of the limit block (6) is adjacent to the limit sleeve (5), the limit block (6) is fixed to the lower end side wall of the center pillar (2) by a rivet (61).

3. The rotary coffee bag holder according to claim 2, wherein the limit block (6) is provided with a waist-shaped hole (62), and the rivet (61) mounts with the center pillar (2) by penetrating the waist-shaped hole (62), and the length of the waist-shaped hole (62) is larger than a diameter of the rivet (61).

4. The rotary coffee bag holder according to claim 1, wherein the coffee bag holder (3) is provided with a plurality of coffee bag shelves (33) from top to bottom.

5. The rotary coffee bag holder according to claim 1, wherein the boss (41) is a spherical boss.

* * * * *